US005295511A

United States Patent [19]

Schleinhege et al.

[11] Patent Number: 5,295,511

[45] Date of Patent: Mar. 22, 1994

[54] VALVE MODULE FOR FLUIDIC CONNECTOR STRIP

[75] Inventors: Hermann-Josef Schleinhege; Jens-Olaf Hartig, both of Hanover; Ernst A. Meyer, Wenningsen, all of Fed. Rep. of Germany

[73] Assignee: Mannesmann Aktiengesellschaft, Düsseldorf, Fed. Rep. of Germany

[21] Appl. No.: 3,307

[22] Filed: Jan. 12, 1993

[30] Foreign Application Priority Data

Jan. 13, 1992 [DE] Fed. Rep. of Germany ..... 4200894

[51] Int. Cl.[5] ..... F15B 13/043; F15B 13/08

[52] U.S. Cl. ..... 137/625.64; 137/554; 137/596.16; 137/884

[58] Field of Search ..... 137/554, 596.16, 625.64, 137/884

[56] References Cited

U.S. PATENT DOCUMENTS

| | | | |
|---|---|---|---|
| 3,450,160 | 6/1969 | Tess | 137/625.64 |
| 4,815,496 | 3/1989 | Nishitani et al. | 137/884 |
| 4,889,164 | 12/1989 | Hozumi et al. | 137/625.64 |
| 5,048,569 | 9/1991 | Stoll et al. | 137/884 X |
| 5,180,318 | 1/1993 | Moller et al. | 137/884 X |

FOREIGN PATENT DOCUMENTS

| | | |
|---|---|---|
| 0464966 | 1/1992 | European Pat. Off. . |
| 3822340 | 1/1989 | Fed. Rep. of Germany . |
| 4004834 | 8/1991 | Fed. Rep. of Germany . |

*Primary Examiner*—Gerald A. Michalsky

*Attorney, Agent, or Firm*—Horst M. Kasper

[57] ABSTRACT

A valve module for fluidic connector strips is furnished in each case with a base plate (1). Parallel disposed, fluidic connector channels (2) are placed in the base plate (1). The base plate (1) is furthermore immediately connectable with a main valve (3), communicating with the connector channels (2). The valve module further exhibits a precontrol pilot valve (4) disposed on the main valve (3). The motion of the valve member of the main valve (3) is controllable by the precontrol pilot valve (4) based on a passage flow through a control channel (5) of the main valve (3). The precontrol pilot valve (4) includes an electromagnetic valve with electrical plug contacts (6). The electric plug contacts (6) are protected against humidity and moisture. In order to furnish a quick, safe and adaptable, as well as an easily assembled electrical connection of the electrical connector lines to the electromagnet valves and from one valve module to the next valve module and in order to provide additional electric connections for such valve modules, a hollow cable casing (8) is disposed at a narrow side front face (7) of the base plate (1). A plug-in casing (9) is guided telescopically adjustable in the cable casing (8). The plug-in csing (9) is attached to an angle cover structure (10). The angle cover structure (10) includes an electrical connector socket (11) for the plug contacts (6) of the electromagnet (12) in the precontrol pilot valve (4) as well as an electrical contact transition structure (49) to the plug-in casing (9).

28 Claims, 3 Drawing Sheets

VALVE MODULE FOR FLUIDIC CONNECTOR STRIP

BACKGROUND OF THE INVENTION

1. Field of the Invention

The invention relates to a valve module for fluidic connector strips with in each case a base plate, wherein parallel fluidic connector channels are running in the base plate, and wherein the base plate is furthermore immediately connectable to a main valve communicating with the connector channels, and with at least a precontrol pilot valve disposed on the main valve, and wherein the precontrol pilot valve controls the movement of the valve member of the main valve based on a passage flow through a control channel of the main valve.

2. Brief Description of the Background of the Invention Including Prior Art

It is known to provide a valve module for fluidic, i.e. hydraulic or pneumatic, connector strips, including a base plate. Parallel disposed, fluidic connector channels are positioned in the base plate. A fluidic connector strip is a section providing a sequence of connection ports connected to or connectable to fluid connector channels. The base plate can in addition be directly connected to a main valve communicating with the connector channels. At least one precontrol pilot valve is disposed on the main valve. The precontrol pilot valve allows to control the motion of the valve member of the main valve based on a passage flow through a control channel of the main valve. The precontrol pilot valve is formed of an electromagnet valve with electric plug contacts, as described in the German Printed Patent Document DE-Al-4,004,834.

Such directional control valves with a connection layout according to the German Industrial Standard DIN ISO 5599 are furnished with base plates with a field of joining connector channels for pressure lines and for operating lines, for ventilation lines and control lines. The connector channels have to be sealed amongst each other and toward the outside relative to the main valve by a correctly disposed sealing plate. The above mentioned, conventional ISO base plate exhibits a passage of the electrical connector lines through an incorporated cable channel and exhibits a plug contact in the plane of the sealing plate, for a connector socket in a valve or in an intermediate plate. The precontrol pilot valves are screwed onto the narrow side front faces. This construction arrangement is not only sensitive to humidity such that the danger of short circuit arises, but in addition is very expensive and difficult to assemble. The complete valve module has to be demounted and disassembled in case of a short circuit in the intermediate plate in order to reach the connector socket in the intermediate plate and the plug contacts in the base plate. A disadvantageously large assembly and mounting time is required, which can result in a loss of production time and/or a production stoppage in associated production lines, and wherein the kind of the cable feed increases further the risk of a short circuit.

SUMMARY OF THE INVENTION

1. Purposes of the Invention

Is an object of the present invention to provide an electrical connection from the electrical connector lines to the electromagnet valves, from one valve module to a second valve module, and further electrical connections for such valve modules, wherein the electrical connections are protected against humidity and water and are in addition easily assembled and mounted.

It is another object of the present invention to provide a modular system for making electrical and fluid connections, which employ simple modules, where the electrical sections are substantially separated from the fluid sections and where solenoid valves provide a connection between electrical block parts and fluid block parts.

It is yet a further object of the present invention to provide a modular system which allows interfacing of and building of a distribution structure using different types of combined fluid and electrical block elements.

These and other objects and advantages of the present invention will become evident from the description which follows.

2. Brief Description of the Invention

The present invention provides for a valve module for fluidic connector strips. A base plate has a narrow side front face. A plurality of parallel disposed fluidic connector channels is placed in the base plate. A main valve has a valve member and a control channel and communicates with the plurality of connector channels. The base plate is immediately connectable to the main valve. A precontrol pilot valve is connected to the main valve and controls the motion of the valve member based on a passage flow through the control channel. The precontrol pilot valve includes an electromagnet with electrical plug contacts, which are protected against humidity. The electromagnet actuates the precontrol pilot valve. A hollow cable casing is disposed at the narrow side front face of the base plate. A plug-in structure is guided telescopically adjustable in the hollow cable casing. The plug-in structure includes an electrical connector socket for the plug contacts of the electromagnet in the precontrol pilot valve.

The plug-in structure can include a plug-in casing guided telescopically adjustable in the hollow cable casing and an angle cover structure attachable to the plug-in casing. The angle cover structure can include the electrical connector socket for the plug contacts of the electromagnet in the precontrol pilot valve and an electrical contact transition structure for providing contact to electrical conductors disposed in the plug-in casing.

A second precontrol pilot valve can be connected to the main valve and can control the motion of the valve member based on a passage flow through the control channel. The second precontrol pilot valve can include a second electromagnet with second electrical plug contacts. The second electrical plug contacts can be protected against humidity. The second electromagnet can actuate the second precontrol pilot valve.

The angle cover structure, connected to the telescopically adjustable plug-in casing, can include a first and a second integrated electrical connector socket disposed side by side at a distance from each other for engaging the respective electrical plug contacts of the respective electromagnet in the respective precontrol pilot valve.

First electrical cables can be disposed in a first insulating material in the angle cover structure. First plate terminals can be disposed in a second insulating material in the angle cover structure. Second electrical cables can be disposed in a third insulating material in the plug-in casing. Second plate terminals can be disposed in a fourth insulating material in the plug-in casing.

Electrical cables and plate terminals can be disposed in the respective insulating material in the plug-in structure.

The plug-in casing can be stepwise adjustable and lockable in the hollow cable casing having steps adapted to match corresponding respective thickness distances of a member of the group selected from a pressure control plate regulator, a throttle plate, and a pressure blocking plate for disposing the member between the base plate and the main valve.

At least one cable storage space can be furnished in the hollow cable casing. Excess cable length for an extendible electrical cable can be contained in the cable storage space.

The hollow cable casing can be furnished with a first opening and with a second opening. The first opening can be disposed relative to the second opening at opposite side faces of the hollow cable casing for a free cable feed-through. The hollow cable casing can be disposed neighboring to a foot region of the base plate.

A connector plate can be disposed neighboring to the base plate and to the hollow cable casing. Electrical cables, sealed with sealing collars, can be fed through the connector plate adjoining at the hollow cable casing.

A bush for connecting initiators can be furnished at the plug-in structure. A display element can be disposed on the plug-in structure for displaying a respective switching state ON/OFF. Further display elements can be provided for displaying the switching state of the valve. The display element indicating the respective switching state ON/OFF can be furnished as light emitting diode LED display.

The advantages achieved according to the present invention comprise in particular that all cables are protected against humidity, that also the groups of plug contacts or, respectively, the connector sockets are protected against humidity and water, and that an extremely simple accessibility for mounting, demounting and surveillance exists. In addition, it is furthermore advantageous to furnish the valve module with unequally thick main valves or with a modular height level linkage, which is made possible by the telescopically adjustable plug-in casing.

An advantageous embodiment of the invention allows to furnish a plug-in casing for one or several plug-contact groups according to the same principle of the protection against humidity and of the accessibility during assembly and mounting and, respectively demounting.

A further improvement provided by the present invention includes that the electrical cables or, respectively, the circuit bonds are cast into an insulating material or, respectively, are welded with ultrasound in the angle piece plate including the telescopically adjustable plug-in casing. The cable or, respectively, the device elements are thereby placed at a certain distance from each other and their position is fixed.

According to further features of the present invention, it is provided that the plug-in casing can be stepwise or continuously adjusted and locked in the hollow cable casing, and in fact in the respective thickness distances of a pressure regulator plate, a throttle plate, or, respectively, a pressure blocking plate disposed between the base plate and the main valve. The advantage includes a universal usability for differing fluid elements, which can only be composed during mounting. In addition, the advantage of later furnished assembly changes exists.

It is advantageous for the individual different combinations of fluid-technical device components, where at least a cable storage room is provided in the hollow cable casing, wherein excessive cable length for an extendible cable is contained in the cable storage space.

The humidity protection and moisture-proofing can be improved by furnishing adjacently disposed and adjoining cable casings at opposite side faces with an opening in the foot region of a base plate for a free cable feed-through. In addition the cables, sealed with the aid of sealing collars or sealing sleeves are fed through a central connector plate, adjoining at the last or at the first cable casing.

The furnishing of a bush for the connection of initiators at the angle piece plate provides further advantages in connection with the elements indicating the respective switching state ON/OFF, as well as possibly further elements for indicating the switching state of the valve.

If optical displays are preferred it is possible, based on constructive and switching technical features, to furnish the elements, indicating the respective ON/OFF switching position as light emitting diode LED displays.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

In the accompanying drawing, in which are shown several of the various possible embodiments of the present invention.

DESCRIPTION OF THE INVENTION AND PREFERRED EMBODIMENTS

Figure 3:
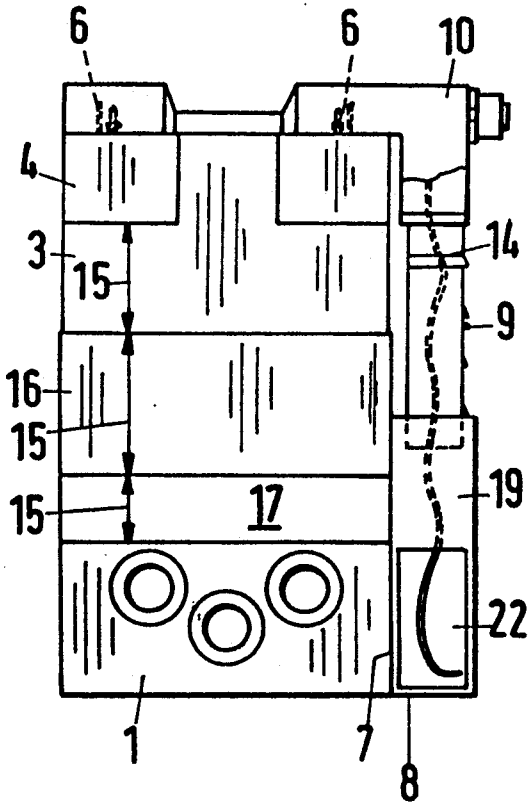
FIG. 3 is a schematic front elevational view of a base plate with a throttle or, respectively, pressure blocking plate and an automatic pressure control device disposed connected under the main valve.

The present invention provides for a valve module for fluidic connector strips with in each case a base plate. Parallel disposed, fluidic connector channels are placed into the base plate. The base plate is immediately connectable with a main valve communicating with the connector channels. A precontrol pilot valve is disposed on the main valve. The precontrol pilot valve controls the motion of the valve member of the main valve based on a passage flow through a control channel of the main valve. The precontrol pilot valve includes an electromagnetic valve with electrical plug contacts, which are protected against humidity. A hollow cable casing 8 is disposed at a narrow side front face 7 of the base plate 1. A plug-in casing 9 is guided telescopically adjustable in the cable casing 8. The plug-in casing 9 forms an angle cover structure 10. The angle cover structure 10 includes an electrical connector socket 11 for the plug contacts 6 of the electromagnet 12 in the precontrol pilot valve 4, as well as an electrical contact transition structure 49 to the plug-in casing 9.

The angle piece plate 10 of the telescopically adjustable plug-in casing 9 can include integrated electrical connector sockets 11, disposed side by side at a distance from each other, for several groups of plug contacts 6 of several electromagnets 12 in several precontrol pilot valves 4.

The electrical cables 13 and plate terminals, respectively, can be cast in an insulating material 14 or, respectively, are welded by ultrasound in an insulated material 14 in the angle cover structure 10 including the telescopically adjustable plug-in casing 9.

The plug-in casing 9 can be stepwise adjusted and locked in the hollow cable casing 8, and in fact in corresponding respective thickness distances 15 of a pressure control plate regulator 16, a throttle plate 17 or, respectively, a pressure blocking plate 18 disposed between the base plate 1 and the main valve 3.

At least one cable storage space 19 can be furnished in the hollow cable casing 8. Excess cable length 20 for an extendible electrical cable 13 can be contained in the cable storage space 19.

Cable casings 8 can be furnished at opposite side faces 21 with an opening 22 in the foot region 23 of the base plate 1 for a free cable feed-through 24. The electrical cables 13, sealed with sealing collars 26, can be fed through a central connector plate 25 adjoining at the first cable casing 8 and at the last cable casing 8, respectively.

A bush 27 for the connection of initiators 28 can be furnished at the angle piece plate 10, with elements 29 displaying the respective switching state ON/OFF, as well as with possibly further display elements for displaying the switching state of the valve. The elements 29, indicating the respective switching state ON/OFF, can be furnished as light emitting diode LED displays 30.

The valve module includes a base plate 1 with several parallel disposed, fluidic connector channels 2 and a main valve 3. The main valves 3 subjected to compressed air or a hydraulic fluid as 5/2-way directional control valve according to the German Industrial Standard DIN ISO 5599. At least one precontrol pilot valve 4 is disposed on the main valve 3. The passage flow through a control channel 5 (FIG. 6) of the base plate 1 and of the main valve 3 allows to control the motion of the valve member of the main valve based on the precontrol pilot valve 4 disposed on the main valve 3. The precontrol pilot valve 4 comprises an electromagnet valve with electric plug contacts 6, which are protected against humidity. The base plate 1 is furnished with a first side 101 on the top of the base plate 1, a narrow-side front face 7, a narrow-side rear face 77, a first connection face 201, and a second connection face 202.

For this purpose, a hollow cable casing 8, made of a suitable plastic material, is disposed at the narrow-side front face 7 of the base plate 1. The cable casing 8 is attached at the base plate 1 by way of a not in detail illustrated, however, a conventional plug connection is employed, for example, of a strip structure or of a strip dovetail structure. Furthermore, a plug-in casing 9 is telescopically adjustably guided in the cable casing 8 and is connected to an angle section structure and/or angle cover structure 10. The angle section structure 10 exhibits an electrical connector socket for the plug contacts 6 of an electromagnet 12 in the precontrol pilot valve 4, as well as an electrical contact transition structure 49 (FIG. 5) for attachment at the plug-in casing 9.

Figure 2:
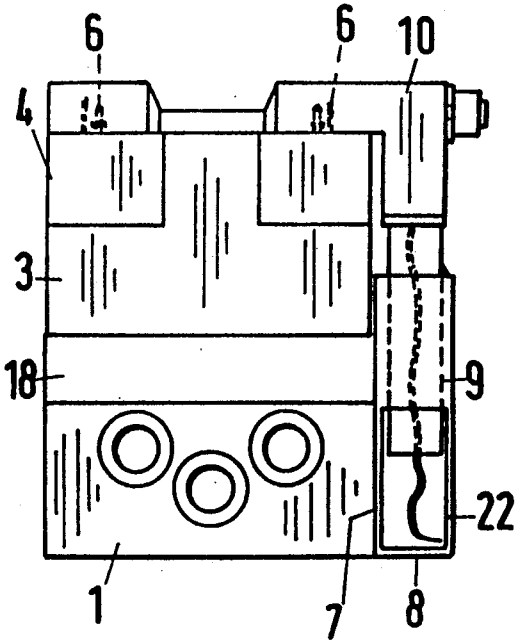
FIG. 2 is a schematic front elevational view of a base plate with a throttle plate or a pressure blocking plate disposed connected under the main valve.
Figure 1:
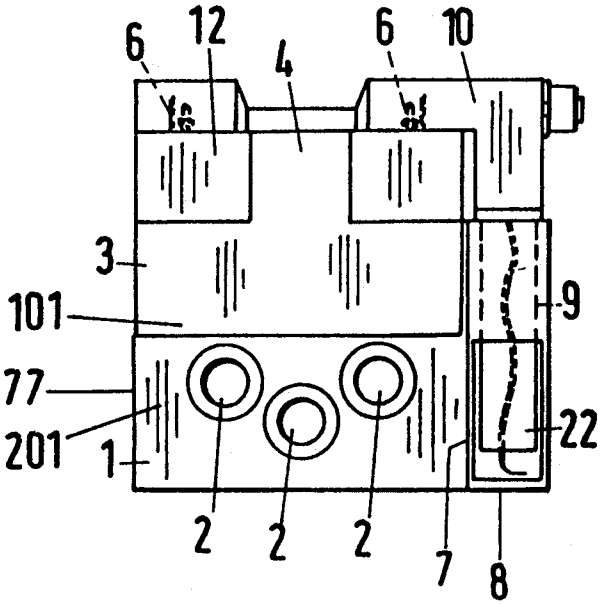
FIG. 1 is a schematic front elevational view of a base plate with a main valve and precontrol pilot valves.

The angle cover structure 10 of the telescopically adjustable plug-in casing 9 is furnished with integrated electrical connector sockets 11, disposed side by side and at a predetermined distance from each other, for a plurality of say, for example, two groups of plug contacts 6 of a plurality of, i.e., in this case two electromagnets 12 in a plurality of respective precontrol pilot valves 4. The electrical cables 13 (FIG. 6), are for example cast into an insulating material 14 at least in the angle cover structure 10 or also including the telescopically adjustable plug-in casing 9. In addition to the blocking of humidity, the plug-in casing 9 together with the angle cover structure 10 is associated with the advantage to balance differing thickness distances 15, for example for main valves 3 of differing thickness as illustrated in FIG. 1, for the additional incorporation of automatic pressure control plate 16, of a throttle plate 17 as shown in FIG. 3, or for a pressure blocking plate 18 as shown in FIG. 2. It is further possible to provide plug-in casings which correspond in their vertical length to a respective vertical length of the automatic pressure control plate 16, of the throttle plate 17, and/or, respectively, of the pressure blocking plate 18.

Figures 6, 7:
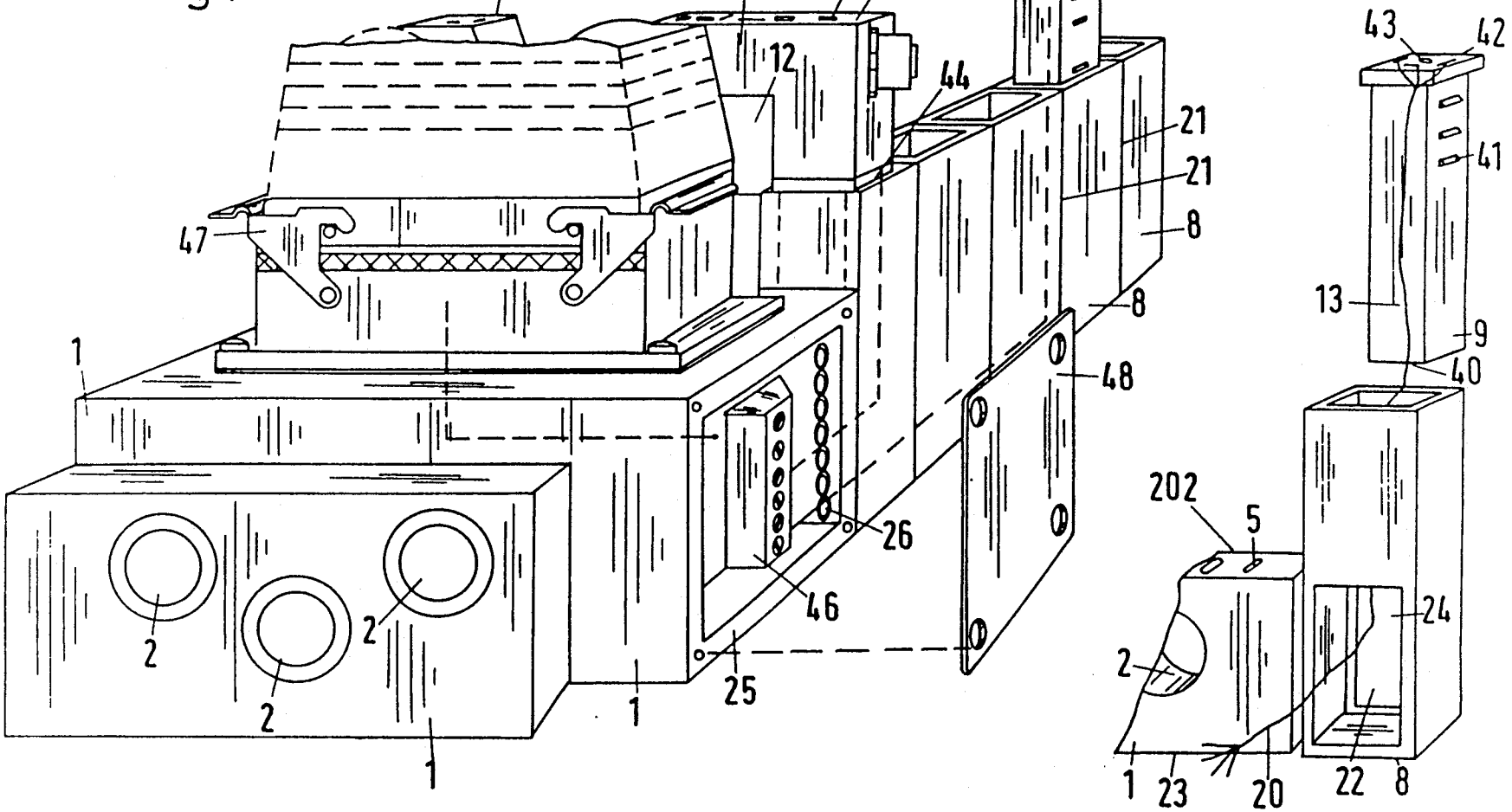
FIG. 6 is a perspective view of a section of the base plate with a cable casing and a plug-in casing.
FIG. 7 is a perspective view of a fluidic device group, comprising several valve modules, with a central connector plate, in a view where the closure cover is shown in a removed position.

A cable trough or a cable storage space 19 is formed at least in the hollow cable casing 8 in this construction, wherein excessive length of cable 20, as illustrated in FIG. 6, is contained for an extendible electrical cable 13. The cables cast or otherwise fixed into the plug-in casing can extend outwardly at the lower end of the plug-in casing as desired for being fed into the hollow cable casing 8.

Adjacently adjoining cable casings 8, which are adjoining at opposite side faces 21, as illustrated in FIG. 7, are furnished with an opening 22 in the foot region 23 of the base plate 1 for a free cable passage 24. The electrical cables 13, sealed with sealing collars or sealing sleeves 26 disposed in a wall of a central connector plate and are fed through the central connector plate 25, wherein said central connector plate is adjoining at the last one or a first one of the plurality of cable casings 8.

Figure 4:
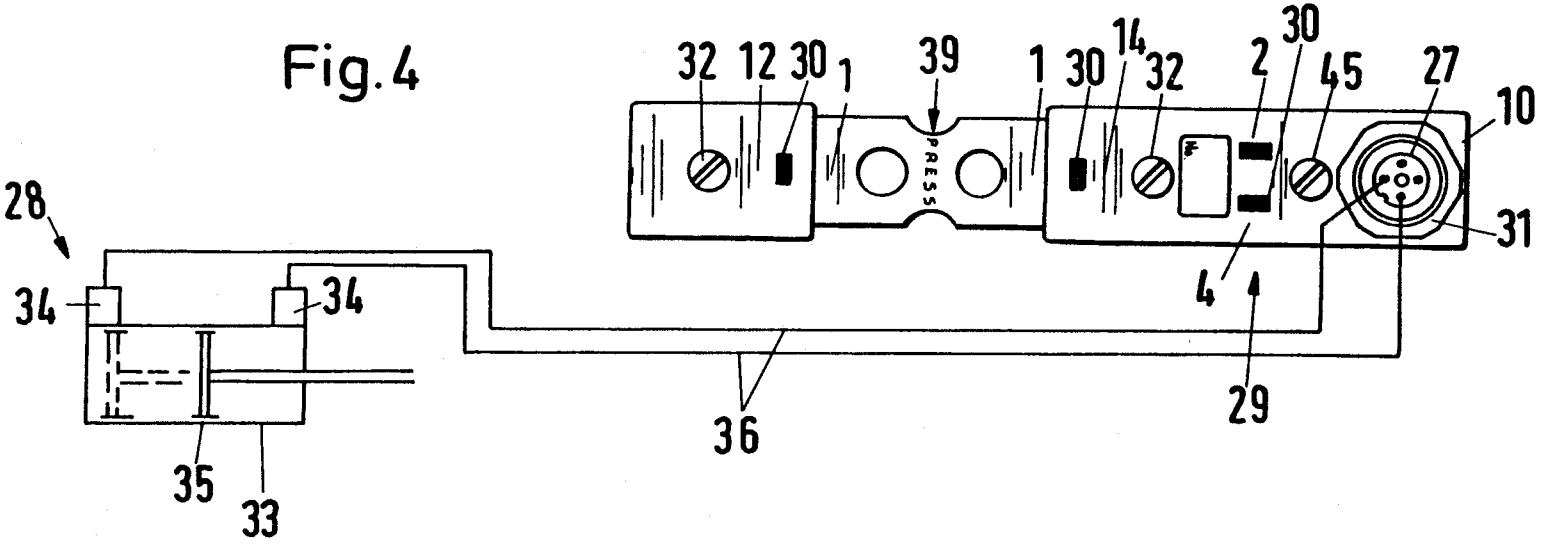
FIG. 4 is top plan view onto an angle piece plate with several integrated connector sockets or, respectively, plugs.

The display elements 29, displaying the respective switching state ON or OFF, are furnished at a bush 27 for the connection of initiators 28 at the angle cover structure 10 as illustrated in FIG. 4. According to the present embodiment, light emitting diode LED displays 30 serve as such elements display 29. The bush 27 includes several connector pole pairs, as illustrated such as for example connected by conductor pair 36. The bush 27 can, as illustrated, be disposed with a pedestal 31 on the angle cover structure 10 or also be disposed by 90 degrees at the front faces on the side of the angle cover structure 10 as illustrated in FIG. 7.

Such initiators 28 emit measurement signals, which are generated from strokes of a lifting cylinder 33 based on permanent magnets, representing initiators, wherein the permanent magnets are attached at the end of the lifting cylinder 33. A piston 35 associated with permanent magnet is moved from a first position drawn with a solid-line into a second position, drawn with a dashed line, and where the piston 35 actuates there a Reed switch 34 based on a change of the magnetic field, such that an electrical signal is generated, which provides for a control of a directional reverse of the piston 35, wherein the piston 35 now again moves into a respective opposite direction. These signals are fed through the conductor pair 36 to the bush 27.

Figure 5:
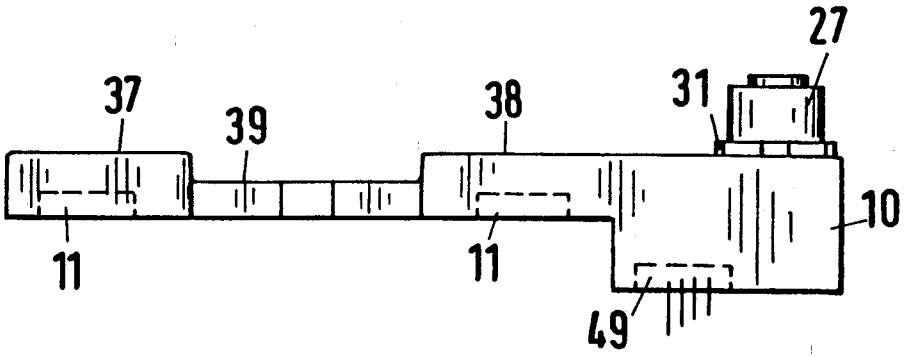
FIG. 5 is a schematic side elevational view of the angle piece plate according to FIG. 4.

The angle cover structure 10, as illustrated in FIG. 5, includes a first casing part 37 and a second casing part 38. The two casing parts are connected with a common center piece and further to a press-on face 39, such that the respective connector sockets are slid and shifted into respective plug contacts 6 by applying manual force onto the press-on face 39, wherein advantageously all contacts are closed simultaneously.

The electrical cables 13 are guided through a waterproof cable opening 40 into the plug-in casing 9, as illustrated in FIG. 6. During mounting, the plug-in casing 9 is then plugged and placed into the proper telescope position by way of locking projections 41. A conductor socket 42 passes thereby also into the proper level position. The angle cover structure 10 is screwed there by way of connection screws 45 or, respectively, 32 into a thread 43 of the plug-in casing 9. In addition, a flat gasket 44 capable of sealing, as illustrated in FIG. 7, is inserted between the plug-in casing 9 and the angle cover structure 10 and can be inserted between the hollow cable casing 8 and the plug casing 9.

All electrical cables 13 are guided at a common clamping strip 46 and the in each case desired electrical switching circuits can be created by a multipole plug connection 47 representing polypole coupler. The central connector plate 25 is then closed by a cover 48 for providing easy accessibility of the conductors. The system is thus protected against humidity but is nevertheless extremely flexible with respect to the selection of the necessary device components for a desired valve function of a pneumatic or a hydraulic circuit.

The base plate 1 can be formed so that both the narrow side front face 7 and the narrow side rear face 77 are adapted for receiving a hollow cable casing 8, a plug-in casing 9 and an angle cover structure 10. The main valve is generally disposed at an upper face 101 of the base plate 1.

The electrical contact transition structure 49 and the electrical connector sockets 11 are preferably aligned for providing in both cases connection by performing motion in a parallel direction.

It will be understood that each of the elements described above, or two or more together, may also find a useful application in other types of valve modules differing from the types described above.

While the invention has been illustrated and described as embodied in the context of a storage tank for liquefied gases, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A valve module comprising a base plate having a narrow side front face;

a plurality of parallel disposed fluidic connector channels placed in the base plate;

a main valve having a valve member and a control channel and communicating with the plurality of connector channels, wherein the base plate is immediately connectable to the main valve;

a precontrol pilot valve connected to the main valve and controlling the motion of the valve member based on a passage flow through the control channel, wherein the precontrol pilot valve includes an electromagnet with electrical plug contacts, which are protected against humidity, wherein the electromagnet actuates the precontrol pilot valve;

a hollow cable casing disposed at the narrow side front face of the base plate;

a plug-in structure guided telescopically adjustable in the hollow cable casing, wherein the plug-in structure includes an electrical connector socket for the plug contacts of the electromagnet in the precontrol pilot valve.

2. The valve module according to claim 1, wherein the plug-in structure includes a plug-in casing guided telescopically adjustable in the hollow cable casing;

an angle cover structure attachable to the plug-in casing, wherein the angle cover structure includes the electrical connector socket for the plug contacts of the electromagnet in the precontrol pilot valve and an electrical contact transition structure for providing contact to electrical conductors disposed in the plug-in casing.

3. The valve module according to claim 2, a second precontrol pilot valve connected to the main valve and controlling the motion of the valve member based on a passage flow through the control channel, wherein the second precontrol pilot valve includes a second electromagnet with second electrical plug contacts, which second electrical plug contacts are protected against humidity, and wherein the second electromagnet actuates the second precontrol pilot valve.

4. The valve module according to claim 3, wherein the angle cover structure connected to the telescopically adjustable plug-in casing includes a first integrated electrical connector socket and a second integrated electrical connector socket disposed side by side at a distance from each other for engaging the first electrical plug contacts of the first electromagnet in the first precontrol pilot valve and, respectively, second electrical plug contacts of the second electromagnet in the second precontrol pilot valve.

5. The valve module according to claim 2, further comprising first electrical cables disposed in a first insulating material in the angle cover structure;

first plate terminals disposed in a second insulating material in the angle cover structure;

second electrical cables disposed in a third insulating material in the plug-in casing;

second plate terminals disposed in a fourth insulating material in the plug-in casing.

6. The valve module according to claim 2, wherein the plug-in casing is stepwise adjustable and lockable in the hollow cable casing having steps adapted to match corresponding respective thickness distances of a member of the group selected from a pressure control plate regulator, a throttle plate, and a pressure blocking plate for disposing the member between the base plate and the main valve.

7. The valve module according to claim 1, further comprising electrical cables disposed in a first insulating material in the plug-in structure;

plate terminals disposed in a second insulating material in the plug-in structure.

8. The valve module according to claim 1, further comprising at least one cable storage space furnished in the hollow cable casing, wherein excess cable length for an extendible electrical cable is containable in the cable storage space.

9. The valve module according to claim 1, wherein the hollow cable casing is furnished with a first opening and with a second opening, wherein the first opening is disposed relative to the second opening at opposite side faces of the hollow cable casing for a free cable feed-through, wherein the hollow cable casing is disposed neighboring to a foot region of the base plate.

10. The valve module according to claim 9, wherein a connector plate disposed neighboring to the base plate and to the hollow cable casing; and electrical cables, sealed with sealing collars, are fed through the connector plate adjoining at the hollow cable casing.

11. The valve module according to claim 10, further comprising display elements for displaying the switching state of the valve.

12. The valve module according to claim 10, further comprising a display element disposed of the plug-in structure indicating the respective switching state ON/OFF is furnished as light emitting diode LED display.

13. The valve module according to claim 1, further comprising a bush for connecting initiators and furnished at the plug-in structure;

a display element disposed on the plug-in structure for displaying a respective switching state ON/-OFF.

14. A valve module for fluidic connector strips with in each case a base plate, wherein parallel disposed, fluidic connector channels are placed into the base plate, wherein the base plate is immediately connectable with a main valve communicating with the connector channels, and wherein a precontrol pilot valve is disposed on the main valve, wherein the precontrol pilot valve controls the motion of the valve member of the main valve based on a passage flow through a control channel of the main valve, wherein the precontrol pilot valve includes an electromagnetic valve with electrical plug contacts, which are protected against humidity, wherein a hollow cable casing (8) is disposed at a narrow side front face (7) of the base plate (1), wherein a plug-in casing (9) is guided telescopically adjustable in the cable casing (8), and wherein an angle cover structure is attached to the plug-in casing (9), which includes an electrical connector socket (11) for the plug contacts (6) of the electromagnet (12) in the precontrol pilot valve (4), as well as an electrical contact transition structure (49) to the plug-in casing (9).

15. The valve module according to claim 14, wherein the angle cover structure (10) of the telescopically adjustable plug-in casing (9) includes integrated electrical connector sockets (11) disposed side by side at a distance from each other, for several groups of plug contacts (6) of several electromagnets (12) in several precontrol pilot valves (4).

16. The valve module according to claim 14, further comprising electrical cables (13) cast in an insulating material (14) in the angle cover structure (10) including the telescopically adjustable plug-in casing (9).

17. The valve module according to claim 14, wherein the plug-in casing (9) is stepwise adjustable and lockable in the hollow cable casing (8), and in fact in respective thickness distances (15) corresponding to a pressure control plate regulator (16), a throttle plate (17) and a pressure blocking plate (18) disposed between the base plate (1) and the main valve (3).

18. The valve module according to claim 14, wherein at least one cable storage space (19) is furnished in the hollow cable casing (8), wherein excess cable length (20) for an extendible electrical cable (13) is contained in the cable storage space (19).

19. The valve module according to claim 14, wherein cable casings (8) are furnished at opposite side faces (21) with an opening (22) in the foot region (23) of the base plate (1) for a free cable feed-through (24), and wherein the electrical cables (13), sealed with sealing collars (26), are fed through a central connector plate (25) adjoining at a first cable casing (8).

20. The valve module according to claim 14, wherein a bush (27) for the connection of initiators (28) is furnished at the angle cover structure (10), with display elements (29) displaying the respective switching state ON/OFF, and with further display elements for displaying the switching state of the valve.

21. The valve module according to claim 20, wherein the display elements (29), indicating the respective switching state ON/OFF, are furnished as light emitting diode LED displays (30).

22. The valve module according to claim 14, wherein plate terminals are cast in an insulating material (14) in the angle cover structure (10) including the telescopically adjustable plug-in casing (9).

23. The valve module according to claim 14, wherein electrical cables (13) are welded by ultrasound in an insulated material (14) in the angle cover structure (10) including the telescopically adjustable plug-in casing (9).

24. The valve module according to claim 14, wherein plate terminals are welded by ultrasound in an insulated material (14) in the angle cover structure (10) including the telescopically adjustable plug-in casing (9).

25. The valve module according to claim 14, wherein the plug-in casing (9) is stepwise adjustable and lockable in the hollow cable casing (8), and in fact in corresponding respective thickness distances (15) of a pressure blocking plate (18) disposed between the base plate (1) and the main valve (3).

26. The valve module according to claim 14, wherein the plug-in casing (9) is stepwise adjustable and lockable in the hollow cable casing (8), and in fact in corresponding respective thickness distances (15)

corresponding to a pressure control plate regulator (16) and a pressure blocking plate (18) disposed between the base plate (1) and the main valve (3).

27. The valve module according to claim 14, wherein the plug-in casing (9) is stepwise adjustable and lockable in the hollow cable casing (8), and in fact in corresponding respective thickness distances (15) corresponding to a throttle plate (17) and a pressure blocking plate (18) disposed between the base plate (1) and the main valve (3).

28. The valve module according to claim 14, wherein the cable casings (8) are furnished at opposite side faces (21) with an opening (22) in a foot region (23) of the base plate (1) for a free cable feed-through (24), and wherein electrical cables (13), sealed with sealing collars (26), are fed through a central connector plate (25) adjoining at a last cable casing (8).

* * * * *